US006209995B1

(12) United States Patent
Grune et al.

(10) Patent No.: US 6,209,995 B1
(45) Date of Patent: Apr. 3, 2001

(54) INK RESERVOIR, INK RESERVOIR REFILL CONTAINER, AND INK REFILL PROCESS

(75) Inventors: Guerry L. Grune, Virginia Beach; Richard Irving Stow, II, Hampton; Heidi Wachter, Newport News, all of VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 0 days.

(21) Appl. No.: 09/444,392

(22) Filed: Nov. 22, 1999

(51) Int. Cl.[7] ..... B41J 2/175
(52) U.S. Cl. ..... 347/85; 347/86
(58) Field of Search ..... 347/84, 85, 86, 347/87

(56) References Cited

U.S. PATENT DOCUMENTS 5,293,913 * 3/1994 Prszler ..... 141/104
5,920,333 * 7/1999 Bates ..... 347/85

* cited by examiner

*Primary Examiner*—N. Le
*Assistant Examiner*—Anh T. N. Vo
(74) *Attorney, Agent, or Firm*—Oblon, Spivak, McClelland, Maier & Neustadt, P.C.

(57) ABSTRACT

An ink replacement reservoir, refill container and refill method are provided. The replacement reservoir is reusable, and is used as an initial replacement for a previous single-use only reservoir. Once the initial replacement has been effected, subsequent replenishment of the reusable reservoir is accomplished utilizing a refill container or bottle. Since the refill container or bottle need not interface or fit within the confines of the image forming apparatus, it can be of a simple inexpensive design. To minimize the possibility of leakage or scattering of toner, the refill container preferably mates with the reusable replacement reservoir so that the refill container is opened only when mating with the reservoir and so that the refill container must be closed in order to disengage the refill container from the reservoir.

31 Claims, 14 Drawing Sheets

INK RESERVOIR, INK RESERVOIR REFILL CONTAINER, AND INK REFILL PROCESS

BACKGROUND OF THE INVENTION

1. Field of the Invention

The invention relates to devices for refilling image forming apparatuses with ink, and particularly to an ink reservoir which is designed to be easily refillable and a container for refilling the ink reservoir. The invention also provides an advantageous ink refill process.

2. Discussion of the Background

Image forming apparatuses, such as printers, photocopiers, facsimiles, and other wet- and dry-ink printing devices discharge ink in order to form images on paper. Typically, laser printers, photocopiers and facsimiles apply a thermosetting image forming substance such as "dry ink" or what is commonly referred to as "toner" so as to generate images on paper. As image forming processes are performed, the ink used by the device is eventually depleted and therefore, must be refilled. Certain image forming apparatuses are provided with removable ink reservoirs that are not refillable and must be entirely replaced when the supply of ink in the ink reservoir has been depleted.

Alternatively, it has been known to provide ink reservoirs or hoppers of image forming apparatuses with hinged lids that may be opened by hand, thereby allowing ink to be poured into the reservoir from a toner refilling container such as a bottle. However, the average office worker who is assigned the task of refilling image forming apparatuses is typically between the ages of late teens and early thirties and wears at least some white clothing. Toner hoppers which must be refilled by pouring toner from a conventionally-shaped bottle into an open hopper have fallen into disfavor due to the likelihood that ink will splash and/or toner particles may become airborne thereby increasing the risk of inhalation or soiling of the clothing of the user. Therefore, it is important that refilling devices for image forming apparatuses be easy to use and prevent inadvertent spillage or dispersal of ink. As used hereinafter, "ink" is intended to include "dry ink," such as toner, as well as wet ink.

In order to reduce the likelihood that toner is spilled during a refilling operation, it has been known to provide toner refilling containers with specialized engagement surfaces which correspond to engagement surfaces provided on toner hoppers. However, it has been found that these specialized containers are expensive to manufacture and require complicated procedures for refilling a toner hopper. Therefore, in order to avoid complicated refilling procedures that must be performed by end users and avoid any risk of spillage of ink, certain image forming apparatuses are designed to receive non-refillable ink reservoirs which, after having been depleted of ink, must be replaced with an identical reservoir. FIGS. 1 through 4 depict an example of a conventional toner hopper or reservoir 10. As shown in the figures, the toner hopper or reservoir 10 is formed of a generally trough-shaped body 12 having a discharge 14 for feeding toner contained in the body 12 into an image forming apparatus. The outer contours of a typical toner reservoir such as toner reservoir 10 may include numerous contours, notches, or other engagement surfaces which are specifically designed to fit within a particular receptacle for a particular image forming apparatus. For example, toner reservoir 10 includes a curved portion 16, notches 18 and inclined portion 20. Additionally, the receptacle for receiving toner reservoir 10 may be shaped such that a particular length of discharge tube 22 must be provided to toner reservoir 10 in order for the discharge tube 22 to properly fit within the receptacle. As shown in FIG. 1, toner reservoir 10 typically includes a cap 24 that has been permanently sealed after toner reservoir 10 has been filled with toner.

Since the toner reservoir, such as toner reservoir 10, includes numerous unusual contours, shapes and notches, the manufacturing cost of such a container is significantly greater than that of an ordinary bottle. Once this reservoir is depleted, it is removed and replaced with another reservoir. In addition to the problem of having to replace such a relatively expensive reservoir each time it is depleted, the user is additionally inconvenienced if they maintain several different models of image forming apparatuses, since the user must stock toner reservoirs for each different type of image forming apparatus. Therefore, such conventional toner reservoirs have burdened end users with stocking numerous types of expensive, complex shaped toner reservoirs that must be completely replaced each time the respective image forming apparatuses becomes depleted.

Accordingly, an improved reservoir, reservoir refill container and refilling system/process is needed which would eliminate the need for replacement of expensive and complex toner reservoirs and the requirement to stock various types of reservoirs for different image forming apparatus.

SUMMARY OF THE INVENTION

It is an object of the present invention to provide an ink reservoir which reduces the complexity and costs associated with replenishing image forming apparatuses with ink. It is a further object of the invention to provide an ink refilling system or process which allows an image forming apparatus which had previously required the replacement of non-refillable toner reservoirs, to utilize a refillable toner reservoir, while preventing accidental or inadvertent spillage of ink during a refilling operation. While the present invention is described in terms of the overall system or process for refilling a reservoir of an image forming apparatus, it is to be understood that various aspects of the invention could be utilized separately. Thus, certain components of the system or process have utility in combination and also separate from other components as will be apparent from the following brief summary of the invention.

In accordance with the present invention, a reservoir which previously had been replaced upon depletion is initially replaced with a reusable reservoir constructed in accordance with the invention. Once this replacement reservoir is depleted, it need not be replaced again (unless, for example, it should suffer from a mechanical failure). In addition, the refill kit/process of the invention provides a refill bottle or container which is utilized to replenish the replacement toner reservoir so that the replacement reservoir need not require further replacement. This refill bottle preferably includes a closure which is openable when it mates with the toner reservoir to avoid spillage of the toner as it is being transferred from the bottle to the reservoir. Of course, this closure also prevents spillage of the toner when the bottle is being stored or transported. As used herein, the terms "bottle" and "container" are intended in their broadest sense and contemplate various types of containers, jugs, cartons, tubes etc. One of the advantages of the invention is that the refill bottle can be non-descript or generic. In particular, the form of the bottle need not conform to the particular idiosyncracies of a given image forming apparatus. Once the reusable replacement reservoir is installed in an image forming apparatus, the non-descript (and thus relatively inexpensive) bottle is used for subsequent replenishment of the reservoir. Although the reusable replacement reservoir is compatible with the image forming apparatus, the bottle need only be compatible with the refill port of the reusable replacement reservoir. Thus, even if a user has plural types of image forming apparatus, once each has had a reusable replacement reservoir installed, the different reservoirs can be replenished with the same type of bottle simply by including a common refill port for the various reservoirs so that they can each mate with the same type of refill bottle.

In accordance with the invention, when the user desires to replace a toner reservoir which previously was a one-use only reservoir, the user replaces that reservoir with a reusable reservoir having a resealable opening. This resealable opening can be subsequently utilized to replenish the reusable reservoir. In addition, this opening or port is adapted to mate with and cooperate with a refill bottle, so that a refill bottle can be subsequently utilized for replenishing the reusable toner reservoir. Thus, after the first replacement of the toner reservoir, i.e., replacement of the previous one-use only reservoir with the reusable reservoir, subsequent refill operations are effected by filling the reusable reservoir with a bottle which mates with the reusable reservoir. Since the bottle need not conform to the contours or fit of the image forming apparatus, it can be of an inexpensive design and can be generic to various types of reservoirs for various types of image forming apparatus.

BRIEF DESCRIPTION OF THE DRAWINGS

A more complete appreciation of the invention and many of the attendant advantages thereof will be readily obtained as the same becomes better understood by reference to the following detailed description when considered in conjunction with the accompanying drawings, in which:

FIG. 15(*a*) is a top plan view of a closure member rotating in an orifice.

FIG. 31 a is an enlarged view of a center portion of the inner grating shown in FIG. 31.

DESCRIPTION OF THE PREFERRED EMBODIMENTS

Figure 1:
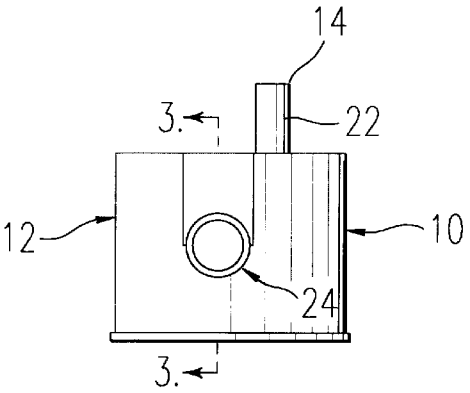
FIG. 1 BACKGROUND ART
FIG. 1 is a top view of a conventional toner reservoir of an image forming apparatus.
Figure 4:
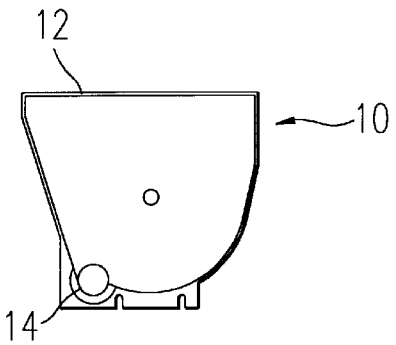
FIG. 4 BACKGROUND ART
FIG. 4 is a rear view of the toner reservoir shown in FIG. 1.
Figure 3:
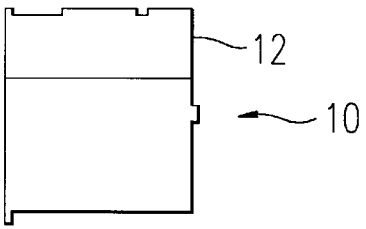
FIG. 3 BACKGROUND ART
FIG. 3 is a cross-sectional view taken along line III—III of the toner reservoir shown in FIG. 1.
Figure 2:
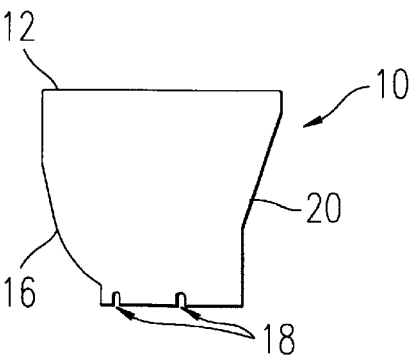
FIG. 2 BACKGROUND ART
FIG. 2 is a front view of the toner reservoir shown in FIG. 1.

Referring now to the drawings, wherein like reference numerals designate identical or corresponding parts throughout the several views, FIGS. 5–17 schematically represent an ink reservoir according to the invention. As shown in FIGS. 5 and 7–9, a toner reservoir 50 is shaped to store an ink within an interior 52 of body 54. As is apparent from the figures, body 54 can include a number of contours and/or engagement surfaces which are specifically designed to be received within an interior space of an image forming apparatus. Additionally, reservoir 50 typically includes an outlet orifice 56 configured to communicate with an inlet orifice of an image forming apparatus (not shown), through which ink, such as dry ink or toner is discharged from interior 52 of toner reservoir 50 to the internal mechanisms of an image forming apparatus. It is to be understood that toner/ink reservoir may have any shape which may be required so that reservoir 50 can be received within the appropriate space of an image forming apparatus where outlet orifice 56 communicates with an inlet orifice of the image forming apparatus. In other words, it is to be understood that while particular forms and shapes of toner reservoirs are depicted and described herein, the present application is applicable to various types and shapes of toner reservoirs.

Figure 5:
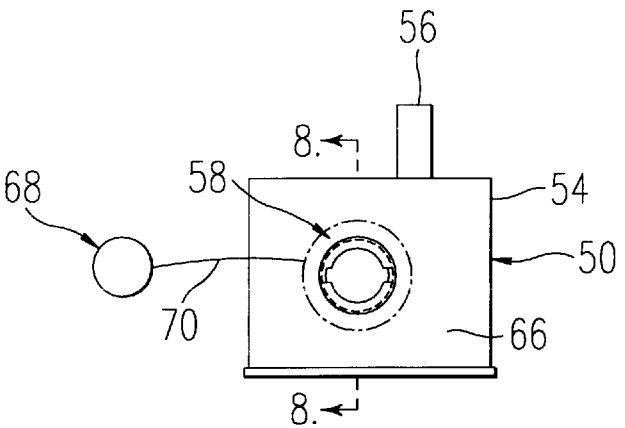
FIG. 5 is a top view of a refillable toner reservoir according to the invention.
Figure 6:
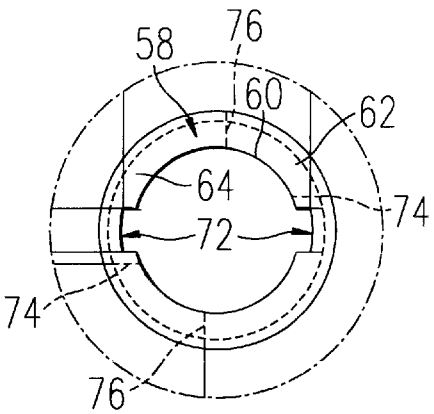
FIG. 6 is an enlarged plan view of a portion of the toner reservoir shown in FIG. 5.
Figure 8:
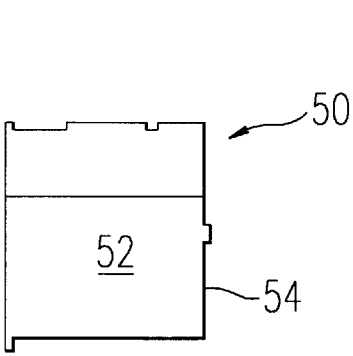
FIG. 8 is a cross-sectional view taken along line VIII—VIII of the toner reservoir shown in FIG. 5.
Figure 7:
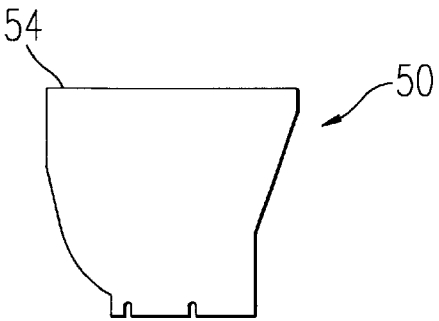
FIG. 7 is a front view of the toner reservoir shown in FIG. 5.
Figure 9:
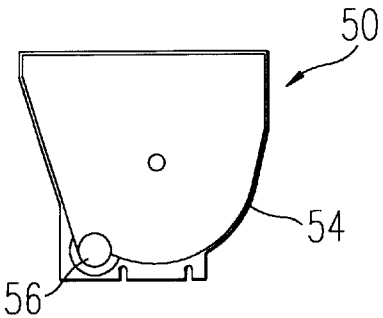
FIG. 9 is a rear view of the toner reservoir shown in FIG. 5.
Figure 12:
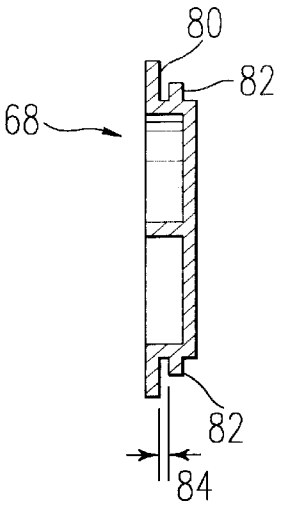
FIG. 12 is a cross-sectional view of the closure member shown in FIG. 11 taken along line XII—XII.
Figure 11:
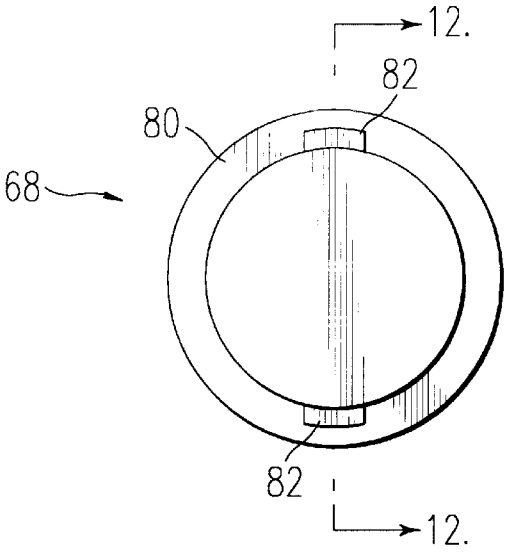
FIG. 11 is a bottom plan view of the closure member shown in FIG. 10.
Figure 10:
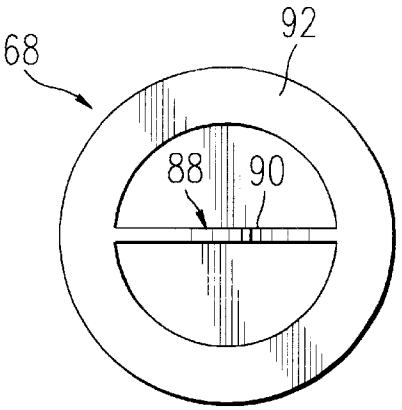
FIG. 10 is a top plan view of a closure member for engagement with the toner reservoir shown in FIG. 5.
Figure 13:
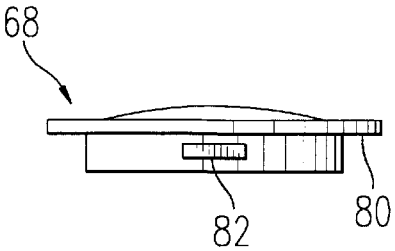
FIG. 13 is a front view of the closure member shown in FIG. 10.
Figure 14:
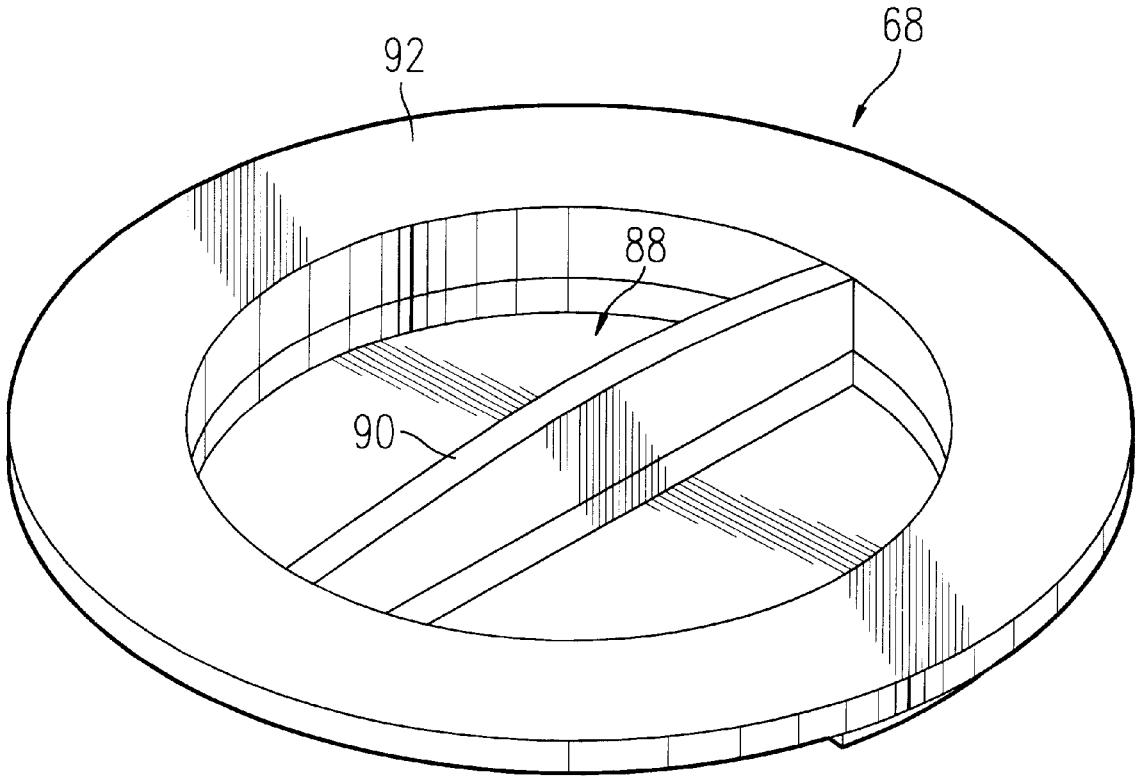
FIG. 14 is a top front left perspective view of the closure member shown in FIG. 10.

As shown in FIGS. 5 and 6, ink reservoir 50 includes refilling orifice 58 which defines a free edge 60 having an outer surface 62 (i.e., on the exterior of the reservoir) and an inner surface 64 (on the interior of the reservoir). Preferably, the orifice also includes slots or recesses as shown at 72. Orifice 58 is provided in a wall 66 of toner reservoir 50 so as to communicate interior 52 of toner reservoir 50 with an exterior of toner reservoir, thereby allowing toner reservoir 50 to be refilled through orifice 58. Attached to body 54 is a closure member 68, which is configured to engage with orifice 58 so as to substantially seal orifice 58 to thereby prevent ink from passing through orifice 58. Closure member 68 may be attached to body 54 via tether 70. Tether 70 may be formed of various materials such as plastics or metal cables. The closure member 68 provides a resealable closure for the reservoir 50. The tether 70 is particularly advantageous in avoiding loss of the closure member when it is removed for refilling of the reservoir 50.

Various sealing expedients may be utilized to further prevent scattering of toner/ink or leakage of toner/ink between the closure member 68 and the reservoir 50 when the closure member 68 is in its closed position. For example, a seal or gasket, or a gasket layer (e.g., a resilient coating) can be disposed upon the surface 80 (FIG. 15) of the closure member 68 to further ensure a tight seal between the closure member 68 and the toner reservoir 50. In addition, or alternately, the inner surfaces 64 of the orifice 58 can be inclined inwardly (toward the interior of the reservoir) so that after the projections 82 of the closure 68 are inserted into the recesses 72, the closing rotation of the closure member 68 causes the projections 82 to ride upon the inwardly inclined inner surfaces 64 to produce a camming action which more tightly draws the closure member 68 against the reservoir 50 to ensure a tight seal. Additional seal or gasket arrangements are discussed in further detail below.

As a further precaution, to prevent leakage or scattering of toner during transport, a film or tape-like seal can additionally be provided over the closure member for the initial shipment of the reservoir. This film-like seal is advantageous for preventing leakage during transport. Once the reservoir has been depleted and is in need of refilling, this seal member must be removed to allow access to the closure member 68 for refilling of the reservoir. Thus, the use of a cover film or seal is generally appropriate for preventing leakage during shipping of the reservoir. For preventing leakage of the toner thereafter, other expedients should be utilized, such as a tightly fitting cap and preferably a cap having a gasket or other suitable sealing expedient. However, since the leak preventing demands encountered in the image forming apparatus (e.g., ensuring that the cap does not become loose as a result of vibration associated with normal image forming apparatus operation) are typically not as great as those which can be associated with the shipping/transport of the reservoir, the additional precaution of an outer film-like seal covering the closure member 68 is not needed after the reservoir has been installed.

Free edge 60 of orifice 58 preferably defines at least two recesses 72. As shown in phantom lines in FIG. 6, inner surface 64 of free edge 60 can include at least two ledges or stops 74 which are arranged adjacent recesses 72. With stop 74 arranged as such, rotation of a member inserted into orifice 58 in an undesired direction is prevented, as discussed in further detail below. Additionally, inner surface 64 of free edge 60 may include stops 76. Arranged as such, stops 76 define an endpoint of a rotation of a member that has been inserted into orifice 58 as also discussed in further detail below.

Figure 15A:
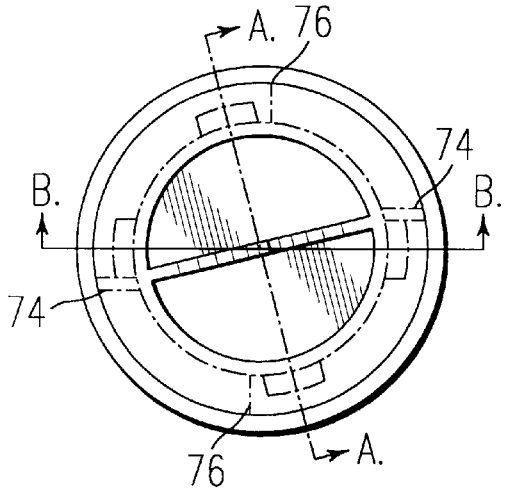
FIG. 15 is a bottom left front perspective view of the closure member shown in FIG. 10.
Figure 15:
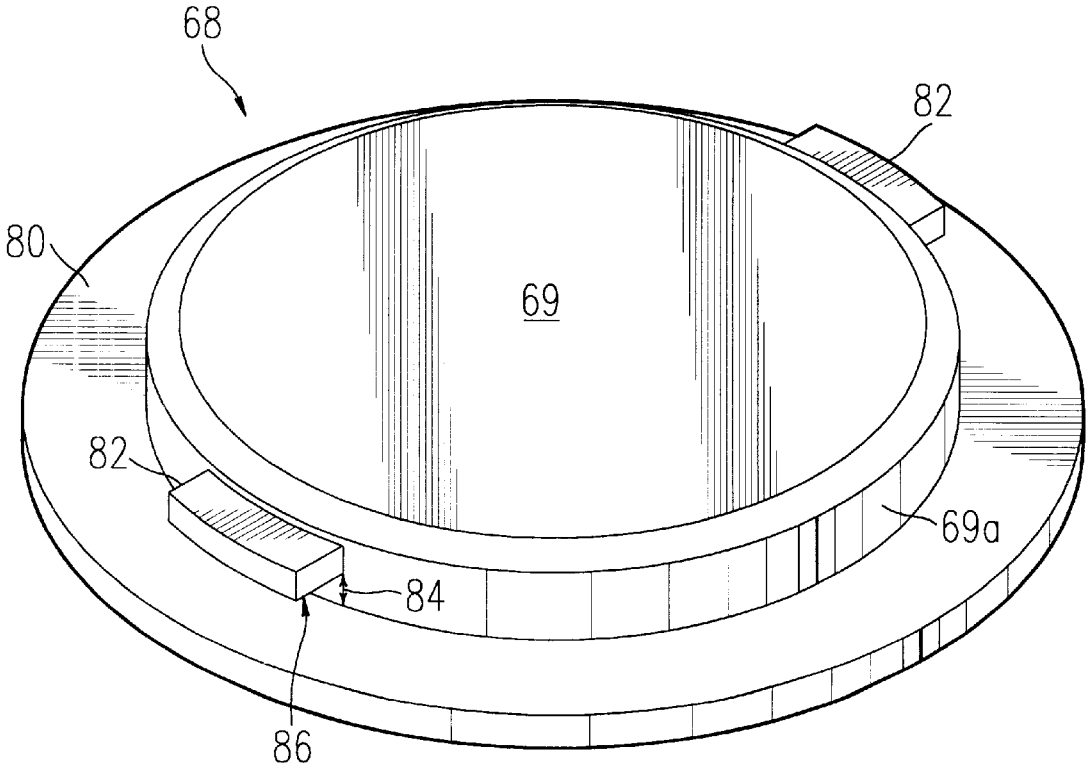
Figure 17:
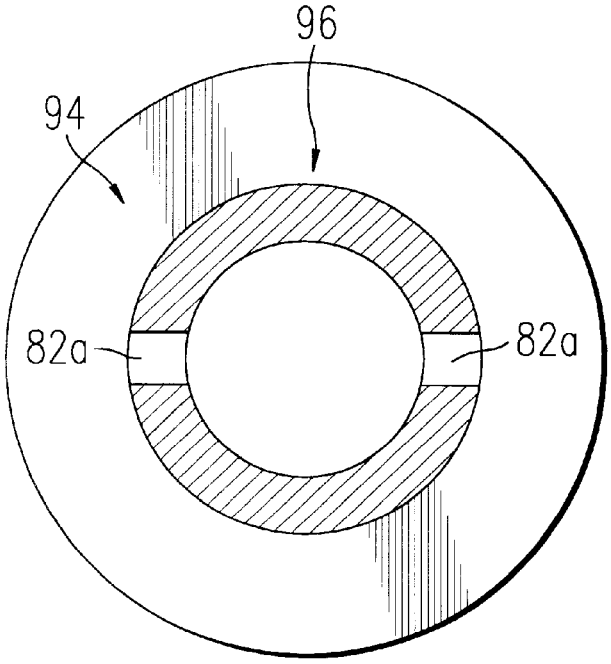
FIG. 17 is a bottom plan view of a seal member according to the invention.

Referring now to FIGS. 10–15, one embodiment of closure member 68 includes an engagement surface 80 and at least one projection 82. Preferably, closure member 68 includes at least two projections 82, arranged such that projections 82 may pass through recesses 72 of free edge 60, thereby allowing engagement surface 80 of closure member 68 to mate with outer surface 62 of orifice 58. Therefore, as shown in FIG. 15*a*, closure member 68 may be inserted into orifice 58 with projections 82 arranged in the position indicated by line B.B. of FIG. 15*a*. Thereafter, in order to close and seal orifice 58 to prevent ink from passing through orifice 58, closure member 68 is rotated in a clockwise direction, as viewed in FIG. 15*a*, such that projections 82 are brought into contact with stops 76. The size of the gap 84 formed between engagement surface 80 and an opposing surface 86 of projection 82 is chosen such that a proper seal is achieved. For example, gap 84 may be sized to approximately the same thickness as free edge 60 and optionally including a machine clearance therefore. In addition, as noted earlier, a gasket or other seal can be associated with the closure member 68 to further ensure a tight sealing relationship between the closure member and the reservoir. FIG. 17 provides an example of such a seal or gasket 94. The seal can be formed of a resilient material and can be provided along the surface 80 of the closure member 68 or, more particularly, in the gap 84 between the projections 82 and the surface 80. The gasket 94 can include recesses 82*a* so that the projections 82 of the closure 68 can be pressed through the gasket to place the gasket into position in the gap 84. If desired, to further enhance the sealing abilities of the gasket, a thinner, and thus more flexible, portion can be provided as shown at 96, with the diameter of this portion 96 smaller than the diameter of the hub portion 69 (FIG. 15) of the closure member 68. Thus, when the gasket is mounted upon the closure member 68, the portion 96 is deformed and maintained along the side portions 69*a* of the hub 69 of the closure member 68 to further prevent leakage along the surfaces 69*a*. Of course, it is to be understood that the seal member or gasket 94 of FIG. 17 is depicted as an example, and various shapes and forms are possible. Also, as discussed earlier, the gasket or seal can also be provided in the form of a coating on one or more surfaces of the closure member 68.

In order for a user to conveniently grasp closure member 68, closure member 68 can include a handle 88 such as transverse wall 90 formed in a recess on an upper surface 92 of closure member 68. Although free edge 60 may include any number of recesses and closure member 68 may include at least one and up to the same number of projections as the number of recesses 72 provided in free edge 60, it is presently believed that two recesses and two projections are sufficient and preferable.

Figure 16:
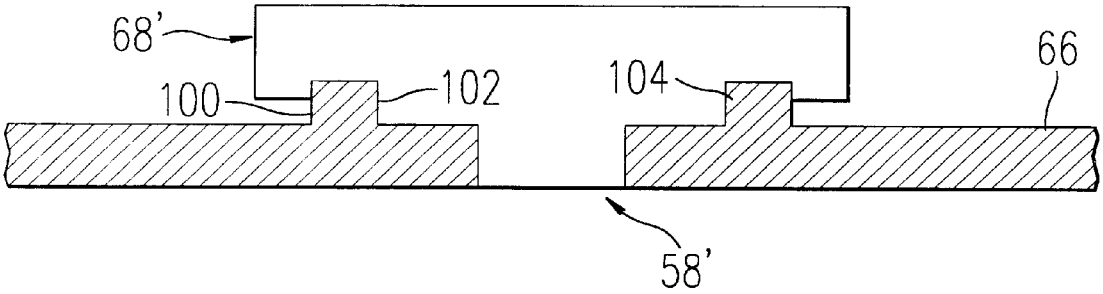
FIG. 16 is a cross-sectional view of a portion of a top wall of a toner reservoir and closure member according to a further embodiment of the first aspect of the present invention.

FIG. 16 depicts an alternate closure member/reservoir interface. In this arrangement, a plug or snap-in type closure 68' is utilized. In the form shown in FIG. 16, an annular wall 100 can be provided upon the reservoir, with the wall 100 having an inner diameter 102 which is sized to provide a slip fit or an interference fit with the outer diameter 104 of a corresponding portion of the closure member 68'. If desired, this annular wall could also have a head or T-shaped portion which would snap in to a similarly shaped recess in the closure member 68' to provide for a further locking or snap-in fit. If desired, the FIG. 16 arrangement could additionally include a recess in the aperture through which projections of the closure extend upon initial insertion of the closure member 68' as discussed earlier with respect to the recesses 72 and projections 82. As discussed earlier, seal members or gaskets can also be provided upon the closure member 68' if desired, and such seals or gaskets could be in the form of either a separate piece or seal coating upon various surfaces of the closure member 68'. As also discussed earlier, preferably, the closure member 68' is tethered to the toner reservoir so that it is not lost when removed for a refilling operation.

By constructing the toner reservoir 50 in accordance with the present teachings, the toner reservoir may be refilled with a generically shaped toner bottle or, in other words, a bottle which need not be designed to conform to the design of a particular image forming apparatus. Additionally, by providing the toner reservoir with a tethered closure member 68 which can releasably engage orifice 58, the present invention allows the toner reservoir 50 to be conveniently opened and closed while preventing the inadvertent misplacement of closure member 68. As discussed earlier, the invention is applicable to various types of toner reservoirs which have heretofore required complete replacement each time the toner reservoir is depleted of ink, such as dry ink or toner. Utilizing the orifice 58 of the reusable replacement reservoir, a user may refill such a toner reservoir with a generically shaped toner refill bottle. Thus, a user is relieved of the burden of stocking numerous different and complex/expensive designs of toner refill bottles and toner reservoirs that are each specifically designed for a particular image forming apparatus.

By providing an orifice with recesses 72, a toner bottle or refill bottle can be sealably engaged with orifice 58 so that inadvertent spillage or generation of airborne ink is avoided while the toner/ink is being transferred from the refill bottle into the reservoir. In particular, the toner bottle is provided with a toner reservoir engagement device 200, described in further detail below, to interlock the refill bottle with the reservoir. Although the arrangement described herein utilizes a pair of projections for the toner reservoir engagement device corresponding to the pair of recesses of the reservoir orifice 58, it is to be understood that a single recess or more than two recesses are also possible.

Figure 18:
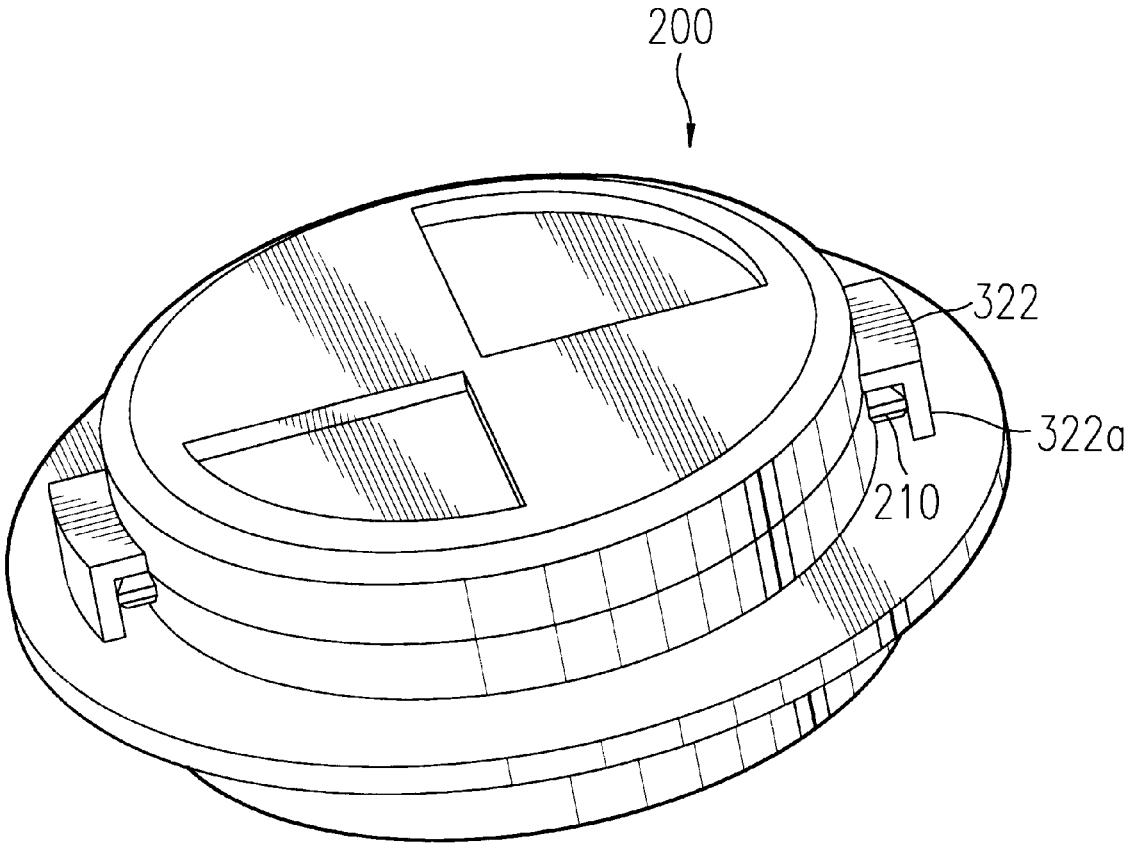
FIG. 18 is a top front left perspective view of an ink reservoir engagement device according to a second aspect of the present invention.
Figure 19:
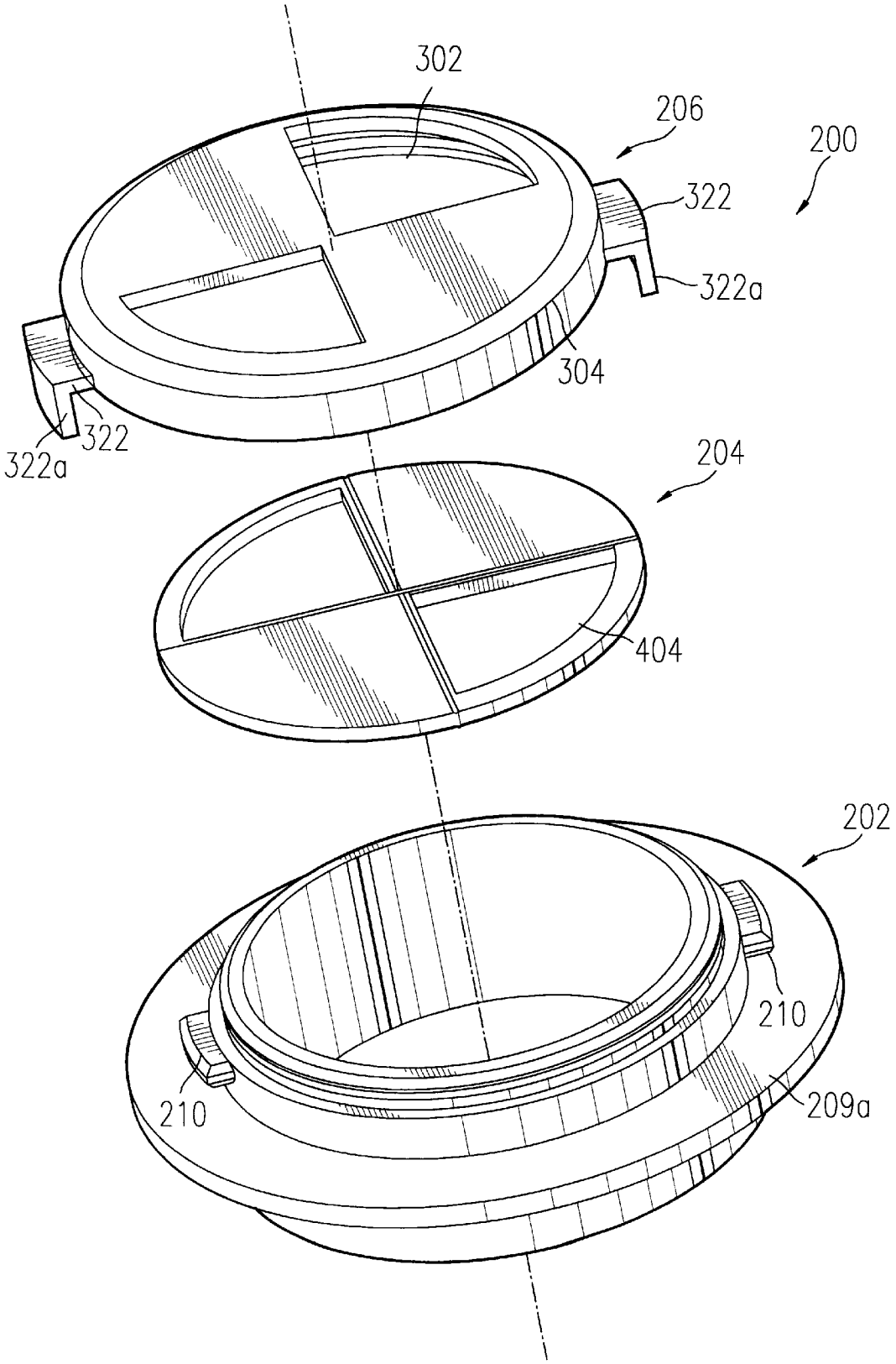
FIG. 19 is an exploded view of the ink reservoir engagement device shown in FIG. 18.

FIGS. 18–35 depict a toner reservoir engagement device 200. FIG. 18 depicts the engagement device in its assembled condition, while FIG. 19 depicts an exploded view of the engagement device 200. The engagement device 200 is referred to herein as a reservoir engagement device, since it engages with and cooperates with the toner reservoir. In fact, the engagement device 200 acts as a gate or a valve for the toner refill bottle so that the refill bottle can selectively dispense toner into the reservoir. As discussed in further detail hereinafter, this engagement device includes gates or gratings operable between opened and closed positions. When the bottle is being stored or transported, the gratings are closed. When the bottle mates with the toner reservoir, relative rotation of the gratings opens apertures in the reservoir engagement device to provide communication between the toner refill bottle and the toner reservoir. If desired, additional sealing expedients can be utilized for storage and transport of the toner bottles, such as an additional exterior cap or a seal film/tape which covers the reservoir engagement device until it is desired to use the toner bottle to replenish a reservoir.

Figure 20:
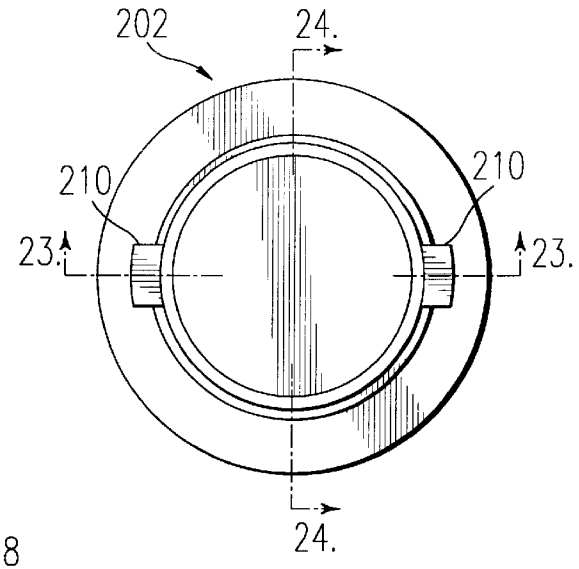
FIG. 20 is a top plan view of the ink reservoir mounting base of the ink reservoir engagement device shown in FIG. 19.
Figure 21:
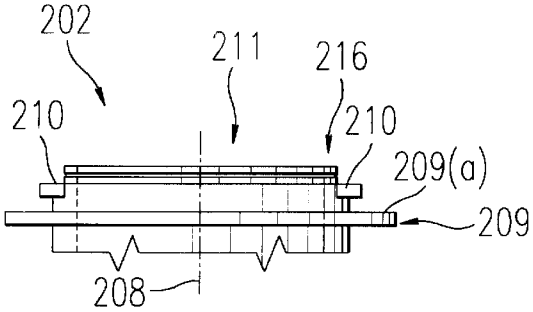
FIG. 21 is a front elevational view of the ink reservoir mounting base shown in FIG. 20.

As shown in FIG. 19, reservoir engagement device 200 includes a base member 202, an inner grating 204 and an outer grating 206. As shown in FIGS. 20–24, base 202 is formed generally of a cylindrical member 207 having an annular wall 209 depending therefrom. Cylindrical member 207 defines an orifice 211. Annular wall 209 includes an engagement surface 209*a*. Additionally, base member 202 includes at least one projection 210 which extends from cylindrical wall 207 and is positioned so as to form gap 212 (FIG. 23) between engagement surface 209*a* and projection 210. Preferably, base member 202 includes at least two projections 210 formed approximately diametrically opposite from each other, as shown in FIG. 20. Also preferably, gap 212 is sized so as to engage a free edge of an orifice formed on an ink reservoir, discussed in detail below with respect to another aspect of the invention.

Figure 24:
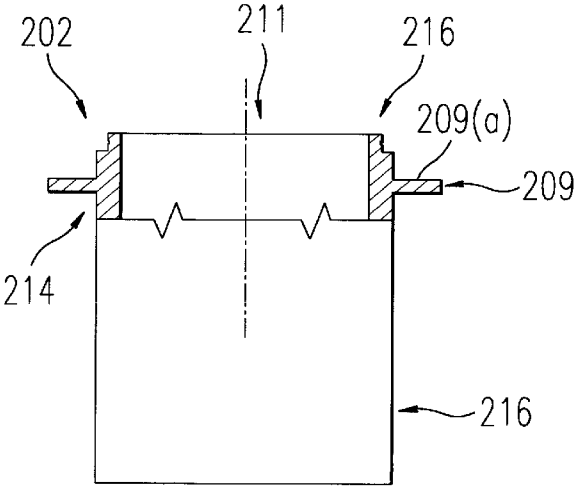
FIG. 24 is a cross-sectional view taken along line XXV—XXV of the ink reservoir engagement base shown in FIG. 20.

As shown in FIG. 24, the base member is disposed, permanently, or releasably, upon an ink/toner container or bottle 216. As shown in FIG. 24, the bottle or container can be of a very simple construction, and thus is much less expensive than toner reservoirs or cartridges which must conform to a mounting site of an image forming apparatus. Although a generally cylindrical container is shown in FIG. 24, it is to be understood that various shapes and forms of containers or bottles can be utilized. The present invention is advantageous in that a simple bottle/container refilling is utilized rather than replacing the reservoir which sits in the image forming apparatus. Since the bottle can be more simply/inexpensively manufactured, the replacement or replenishment of toner is less expensive in accordance with the present invention. In addition, since the bottle need not conform to the image forming apparatus, a generic bottle design can be utilized for various types of image forming apparatus. As discussed earlier, the toner/ink container 216 can store liquid ink or dry ink.

Figure 22:
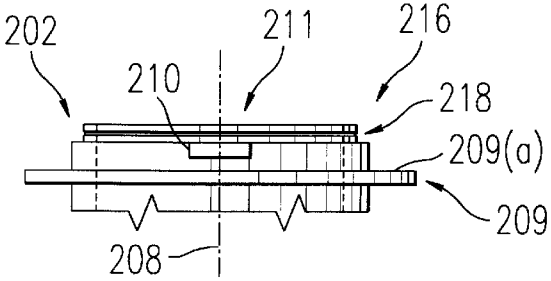
FIG. 22 is a side elevational view of the ink reservoir engagement base shown in FIG. 20.
Figure 23:
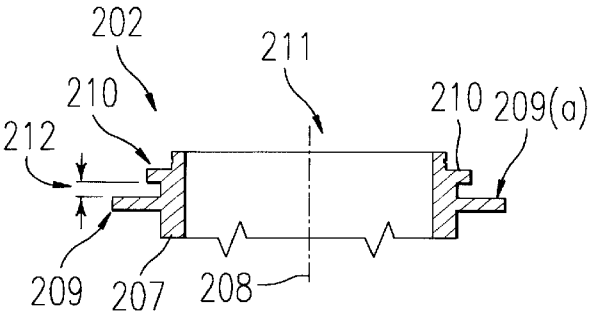
FIG. 23 is a cross-sectional view taken along line XXIII—XXIII of the ink reservoir engagement base shown in FIG. 20.
Figure 29:
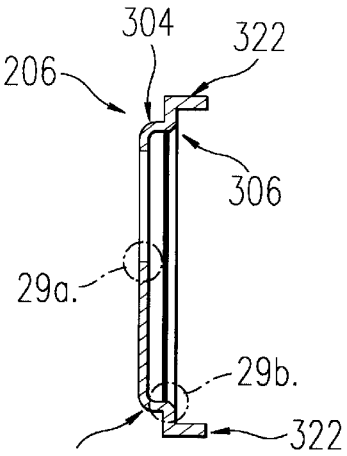
FIG. 29 is a cross-sectional view taken along line XXIX—XXIX of the outer grating shown in FIG. 30.

Upper end 216 of base member 202 includes a groove 218, as indicated in FIG. 22, which is configured to engage with a bead or protrusion 320 formed on outer grating 206 as shown in FIG. 29(*b*). Arranged as such, groove 218 and bead 320 allow the outer grating 206 to rotate relative to base member 202. However, outer grating 206 and base member 202 may be rotatably attached via numerous other mechanisms as would be understood by those skilled in the art.

Referring now to FIGS. 27–30, outer grating 206 is generally formed as a disk preferably including a substantially planar portion 300 having at least one orifice 302. In a presently preferred embodiment, outer grating 206 includes at least two orifices 302, although various numbers of orifices can be utilized. As shown in FIG. 29, at an outer peripheral edge of disk portion 300, an annular skirt 304 is formed. At an end 306 of skirt 304, the bead 320 is formed, which is configured to rotatably engage with groove 218 of base member 202 as shown in FIG. 29(*b*). Constructed as such, outer grating 206 is rotatably engaged with base member 202, thereby providing a rotating cap with at least one orifice 302.

In a presently preferred embodiment, at least one rib or projection 322 (FIGS. 19 and 28) is provided on an outer peripheral edge of outer grating 206 so as to extend radially outwardly from disk portion 300 to a distance beyond projection 210 when outer grating 206 is assembled with base member 202. In a presently preferred embodiment, base member 202 includes at least two projections 210 and outer grating 206 includes at least two ribs or projections 322. Preferably, both projections 210 and projections 322 are arranged at diametrically opposite positions so that projections 210 and 322 are alignable by rotating grating 206 relative to base member 202.

Figure 25:
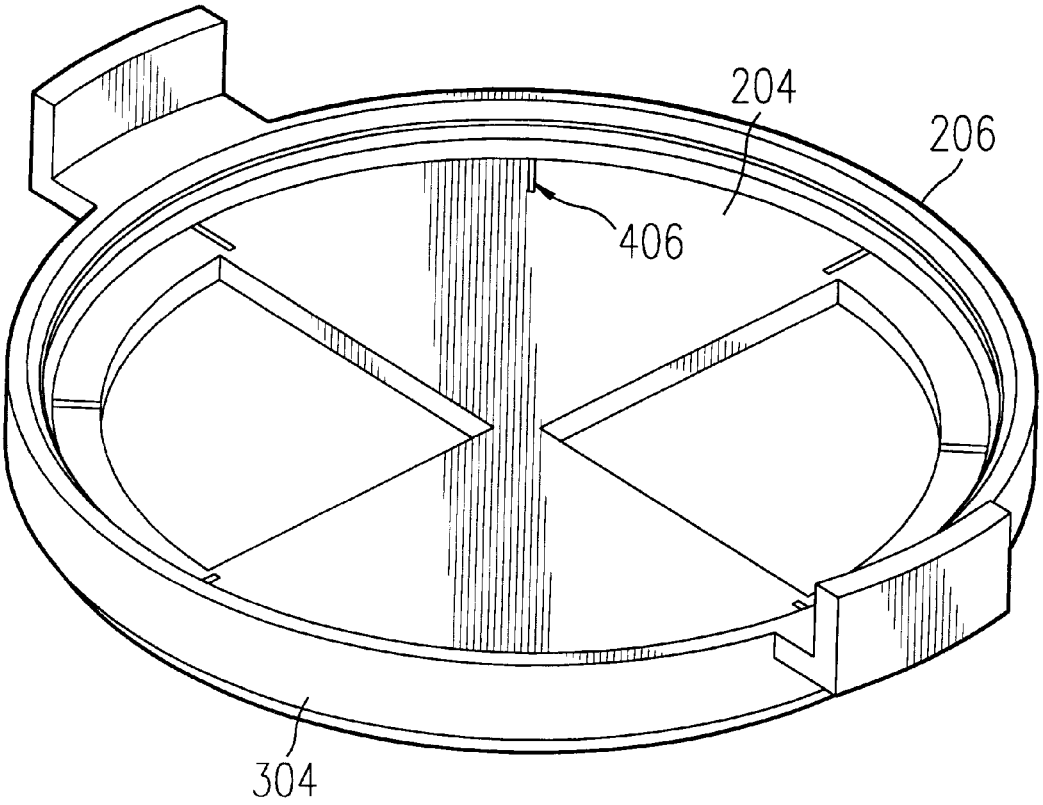
FIG. 25 is a bottom front left perspective view of the inner and outer gratings of the ink reservoir engagement device shown in FIG. 18.
Figure 26:
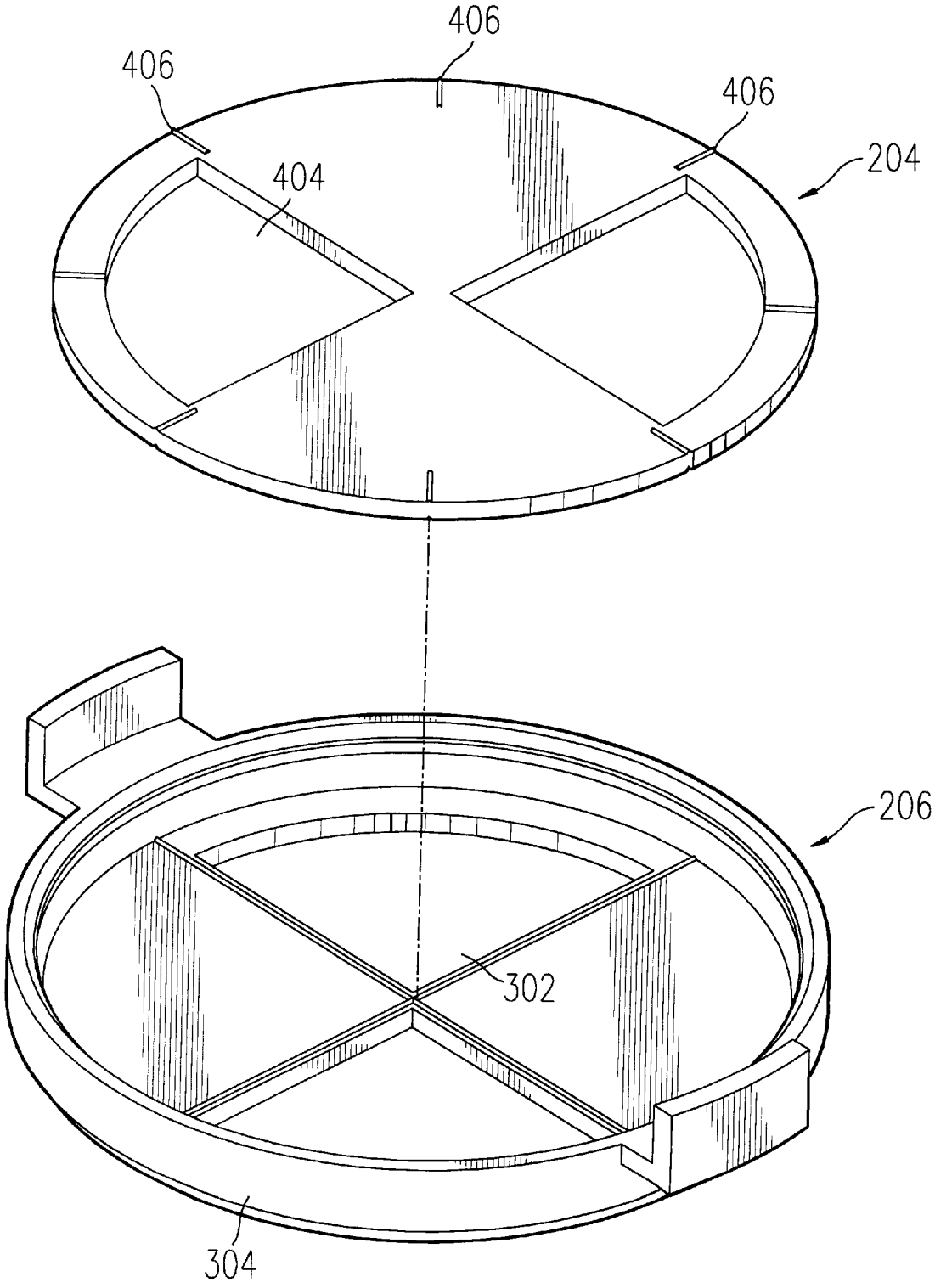
FIG. 26 is an exploded view of the inner and outer grating shown in FIG. 25.
Figure 27:
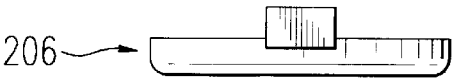
FIG. 27 is a side elevational view of the outer grating shown in FIG. 26.
Figure 28:
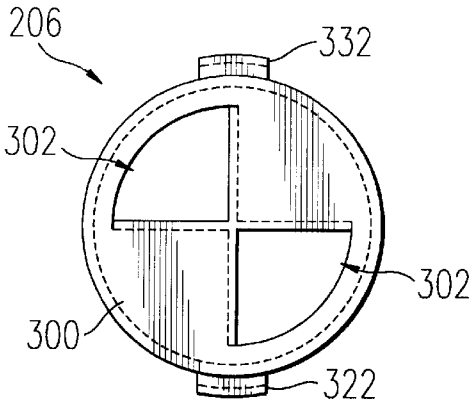
FIG. 28 is a top plan view of the grating shown in FIG. 27.

In order for engagement device 200 to be selectively openable, inner grating 204 is provided between base member 202 and outer grating 206. The inner grating 204 includes apertures which, when aligned or overlapping with corresponding apertures of the outer grating 206, allow communication of the toner refill bottle with the toner reservoir for refilling of the toner reservoir. FIGS. 19 and 26 depict the inner grating 204 removed from the outer grating 206. FIG. 25 depicts an assembled state in which the inner grating 204 is received within a skirt or side wall portions 304 of the outer grating 206.

FIGS. 31–34 depict various details of an example of an inner grating 204 in accordance with the invention. As shown, the inner grating 204 is generally formed of a plate member 400 in the form of a disk 402. Inner grating 204 has at least one orifice 404. Although any number of orifices 404 may be provided in inner grating 204, in a presently preferred embodiment, inner grating 204 has at least two orifices which generally correspond in shape and position to the at least two orifices 302 formed in outer grating 206, except that, when the projections 322 of the outer grating are aligned with the projections 210 of the inner grating or base, the orifices 302 are offset 90° with respect to the orifices 404. In the presently preferred embodiment, the orifices 404 are arranged at diametrically opposite positions upon the inner grating 204. Similarly, the orifices 302 are arranged at diametrically opposite positions upon the outer grating 206. With this arrangement, the engagement device 200 can be opened or closed by rotating outer grating 206 relative to inner grating 204. In addition, alignment of the projections 210, 322 ensures that the gratings, and thus also the container, are closed.

FIG. 18 depicts the inner grating, outer grating and base member 202 assembled together. When this assembly 200 is disposed upon an ink container or ink bottle 216 (FIG. 24), ink within the container 216 can be discharged from the container when the orifices 302 and 404 are aligned, while discharge is prevented when the orifices are not aligned such that the non-apertured portions of the outer grating 206 close the apertures 404 of the inner grating 204.

Inner grating 204 may be formed integrally with or fastened to base member 202 to prevent rotation of inner grating 204 when outer grating 206 is rotated relative to base member 202. By way of example, inner grating 204 can be formed as a separate member, and can include at least one rib formed on a side of the inner grating 204 which faces cylindrical member 207 of base member 202. For example, referring to FIGS. 25, 26 and 31(*a*), inner grating 204 can include a plurality of ribs 406 which contact the base member and thereby provide means for preventing rotation of inner grating 204 relative to base member 202. The ribs 406 can prevent rotation of the inner grating 204 relative to the base member 202 by friction if there is a sufficiently tight coupling between the inner grating 204 and the base member 202 when the engagement device 200 is assembled upon a container. Further, if desired, corresponding grooves can be provided in the base member 202 so that the ribs 406 are received within grooves of the base member when the engagement device 200 is assembled and the inner grating 204 is locked relative to the base member 202. In a presently preferred embodiment, ribs 406 have a height of approximately ⅛ of a millimeter. However, ribs 406 may be formed of any height which would prevent rotation of the inner grating with respect to the base and thus allow the of outer grating 206 to be rotated relative to inner grating 204. It is to be understood that various expedients can be utilized for providing a fixed relationship between the inner grating 204 and the base member 202 so that upon rotation of the outer grating 206, relative rotation between the outer grating 206 and the inner grating 204 is provided. For example, inner grating 204 can be bonded to base member 202 with an adhesive, or through heat sealing. Inner grating 204 can also be formed monolithically with base member 202, thereby also preventing rotation of inner grating 204 with respect to base member 202.

Figure 29A:
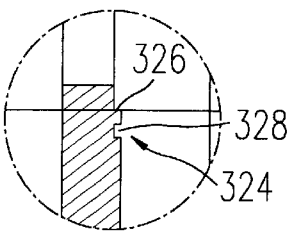
FIG. 29*a* is an enlarged view of a center portion of the outer grating shown in FIG. 29.
Figure 29B:
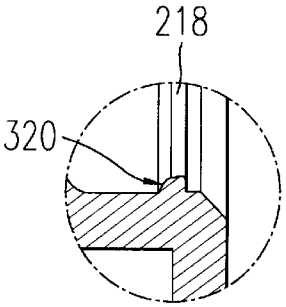
FIG. 29*b* is an enlarged view of a shoulder of the outer grating shown in FIG. 29.
Figure 30:
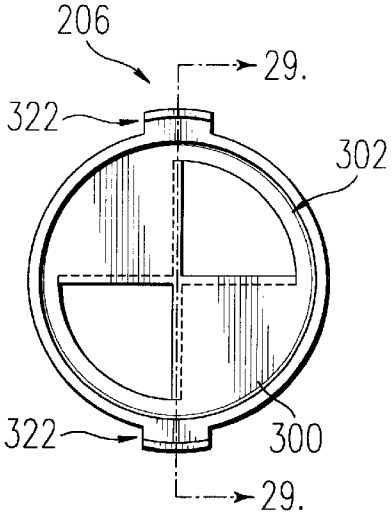
FIG. 30 is a bottom plan view of the outer grating shown in FIG. 28.
Figure 31:
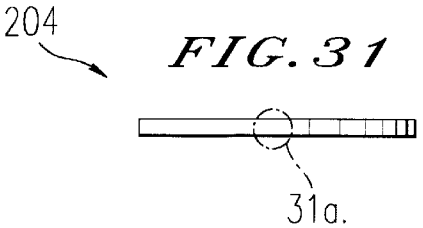
FIG. 31 is a front elevational view of the inner grating shown in FIG. 26.
Figure 32:
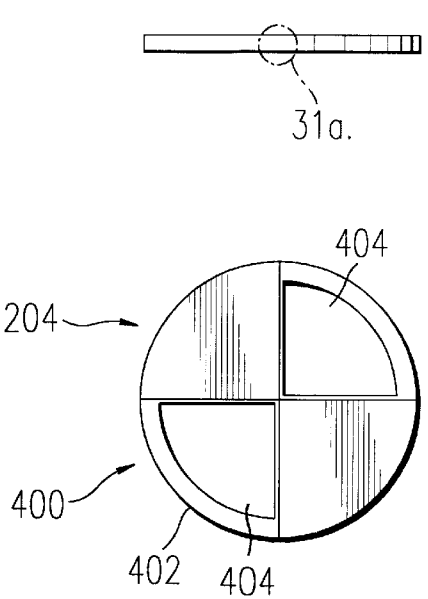
FIG. 32 is a top plan view of the inner grating shown in FIG. 31.
Figure 31A:
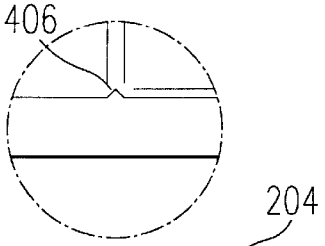
Figure 33:
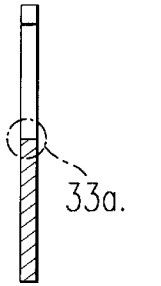
FIG. 33 is a cross-sectional view taken along line XXXIII—XXXIII of the inner grating shown in FIG. 34.
Figure 34:
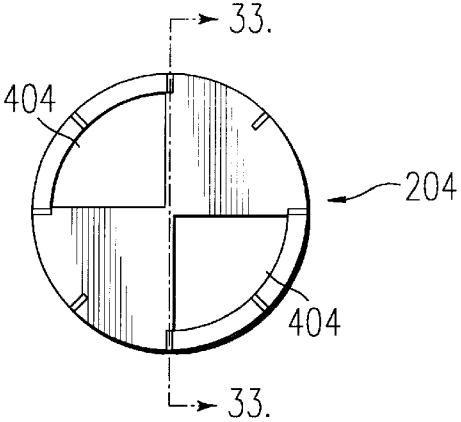
FIG. 34 is a bottom plan view of the inner grating shown in FIG. 32.
Figure 33A:
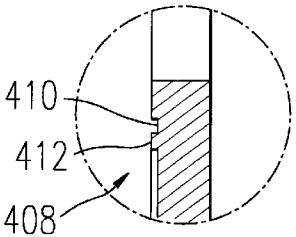
FIG. 33*a* is an enlarged view of a central portion of the inner grating shown in FIG. 33.

Referring now to FIGS. 33 and 33*a*, inner grating 204 can also include an alignment ridge 408, as shown in detail in FIG. 33*a*. FIG. 33*a* is an enlarged view of the portion of FIG. 33 which is circled A. In the FIG. 33*a* arrangement, alignment ridge 408 includes an alignment groove 410 and an alignment protrusion 412 which are configured to mate with an alignment ridge 324 provided on outer grating 206 (as shown in FIG. 29*a*). In particular, outer grating 206 may include an annular alignment protrusion 326 and an annular alignment groove 328 which are configured to mate with alignment groove 410 and alignment protrusion 412, respectively. Provided as such, smooth rotation and proper alignment between inner grating 204 and outer grating 206 is more easily achieved. This is particularly useful so as to ensure the proper alignment of inner grating 204 and outer grating 206 so as to prevent accidental or inadvertent leaking of ink from ink container 216. It is to be understood that various mating or bearing interface arrangements are possible between the inner grating 204 and the outer grating 206 to provide for smooth rotation between the inner grating 204 and outer grating 206. By providing such an aligned rotational interface, the engagement device 200 can also be more tightly assembled (to thereby prevent leakage of toner) while nevertheless allowing for relative rotation of the inner and outer gratings 204, 206 when desired.

Figure 35:
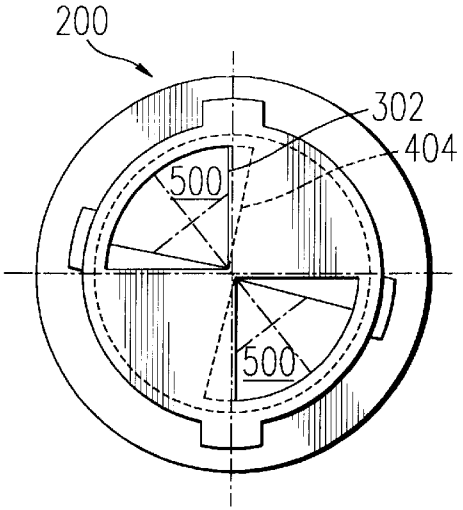
FIG. 35 is a top plan view of the inner and outer gratings mounted on the mounting base shown in FIG. 18.
Figure 36:
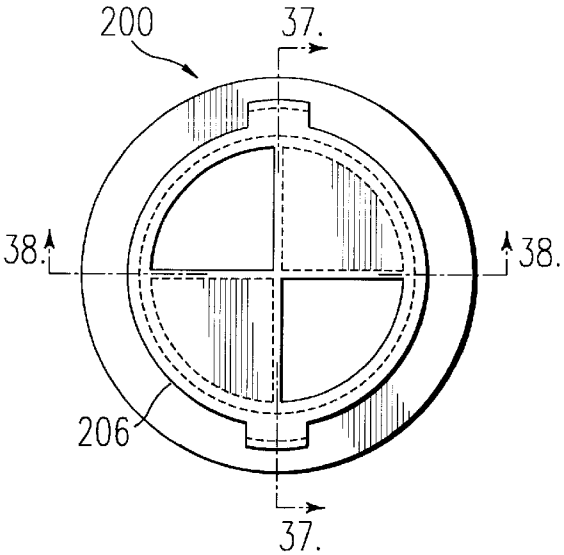
FIG. 36 is a top plan view of the mounting base with inner and outer gratings mounted thereon as shown in FIG. 35.
Figure 37:
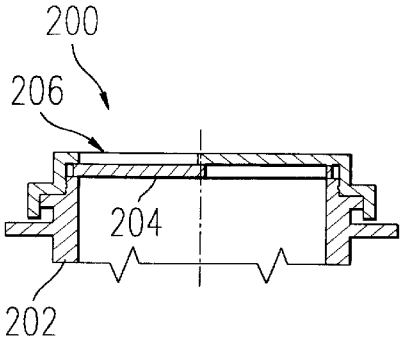
FIG. 37 is a cross-sectional view taken along line XXXVII—XXXVII of the engagement device shown in FIG. 36.
Figure 38:
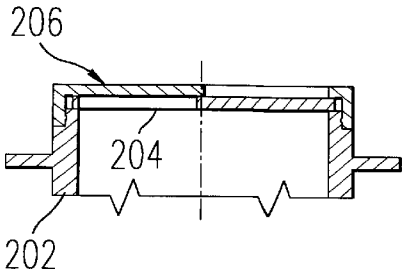
FIG. 38 is a cross-sectional view taken along line XXXVIII—XXXVIII of the engagement device shown in FIG. 36.

With base member 202, inner grating 204 and outer grating 206 assembled as shown in FIGS. 35–38, engagement device 200 may be opened and closed through rotation of outer grating 206 relative to base member 202 and inner grating 204. For example, as shown in FIG. 36, outer grating 206 is positioned such that orifices 302 and 404 do not overlap, thereby closing engagement device 200 so that ink is prevented from passing through engagement device 200. In FIG. 35, base member 202 and inner grating 204 have been rotated counterclockwise, as viewed in FIG. 35, such that orifices 302 and 404 overlap to thereby form through-holes 500 which allow ink to pass through the engagement device 200. Constructed as such, engagement device 200 can be conveniently opened or closed by rotation of outer grating 206 with respect to base member 202 and inner grating 204.

The arrangement of the present invention is particularly convenient for performing refilling operations on an ink reservoir, such as a toner or dry ink reservoir. Referring again to FIGS. 35 through 38, when engagement device 200 is engaged onto an orifice 58 (shown in FIG. 6), which includes a free edge 60 having recesses 72, engagement device 200 can be sealedly engaged with orifice 58 and simultaneously opened simply by rotating a toner container 216 which is connected to base member 202. By rotating the toner container 216 shown in FIG. 24, the base member 202 and associated protrusions 210 are rotated. Since the protrusions 210 are inserted through the recesses 72 when the engagement device mates with the orifice 58, rotation of the protrusions causes the protrusions to move along the inner surface 64 of free edge 60 of orifice 58. Therefore, once through-holes 500 have been formed (i.e., the container is opened), protrusions 210 ensure that toner container 216 is not inadvertently knocked away or otherwise removed from orifice 58, thereby preventing inadvertent spillage of ink during a refill procedure. The stability of toner container 216 and engagement device 200 is optimum where gap 212 formed between protrusions 210 and engagement surface 209*a* of base member 202 is approximately the same as the thickness of free edge 60. Constructed as such, engagement surface 209*a* of base member 202 makes optimal contact with free edge 60 during a refilling procedure such that ink passing through through-holes 500 and orifice 58 does not leak to the exterior. Therefore, the present invention provides a device which can be conveniently used to refill a toner reservoir with a simple motion, i.e., insertion and rotation in order to allow ink from an ink container to refill an ink reservoir.

With reference to FIGS. 6, 18 and 19, a toner refilling operation will be described. As discussed earlier, the aperture or orifice 58 of the toner reservoir includes a first pair of stops 74 and a second pair of stops 76. The stops 74 can prevent reverse rotation of the closure member 68 for the toner reservoir. The stops 74, 76 are shown generally in FIG. 6, since the stops can be of various forms. For example, if desired, the stops 74 can also act as stops limiting excessive rotation of the closure member or, alternately, the stops 76 can limit the rotation of the closure member. Where the stops 74 prevent excessive rotation of the closure member 68, excessive rotation is prevented by the respective sides of the stops 74 opposite to that which provides the reverse rotation prevention. Thus, the stops 74 can prevent both the reverse rotation of the closure member 68 and also limit the forward rotation of the closure member 68 so that, after insertion of the closure member 68, the rotation is slightly less than 180°. Where the stops 76 are utilized to limit rotation of the closure member 68, the rotation of the closure member is approximately 90°. Whether the clockwise rotation of the closure member is limited by the stops 74 or the stops 76 depends upon the relative size and position of the stops 76 with respect to the projections 82 of the closure member. For example, if the projections 82 of the closure member are larger, they will contact the stops 76 so that the closure member rotates approximately 90°. If the projections 82 are smaller relative to the size/position of the stops 76, so that the projections can pass by the stops 76, the closure member 68 can rotate an amount which is slightly less than 180° until the projections contact the stops 74 (the opposite side of the stops which prevent the reverse rotation). The stops 74, 76 are also utilized for controlling opening and closing of the toner refill bottle 216 to replenish the reservoir 50. In particular, the stops 76 can be stops for the projections 322 of the outer grating, while the stops 74 are stops for the projections 210 of the base member. In addition, the stops 74 ensure alignment of the projections 210, 322 for both the base member 202 and the outer grating 206 to thereby ensure alignment of the projections to allow the toner refill container or bottle to be removed when the engagement device is closed.

When a refill operation is desired, the closure member 68 of the reservoir 50 is removed by rotating the closure member until the projections 82 are aligned with the slots 72 of the reservoir refill opening or aperture. The closure member 68 can thus be removed. The toner bottle, in its closed position with projections 210 of the base member aligned with projections 322, is then inserted into the aperture 58 of the reservoir by aligning the projections 210, 322 with the slots 72. The container is then rotated clockwise. Once the container has rotated approximately 90°, the stops 76 engage with the projections 322, but they do not engage with the projections 210. The stops 76 can be sized or positioned to engage the projections 322 but not the projections 210, since the projections 322 extend farther radially than the projections 210 and, in addition, the projections 322*a* include a depending arm or ledge 322*a* as discussed further below. As a result, upon further rotation, the outer grating 206 does not move, but the remainder of the bottle can continue to rotate to thereby provide the relative rotation between the outer grating 206 and the inner grating 204. This rotation can continue until the projections 210 engage the stops 74, at which point the bottle or container 216 is in the fully open position and the toner or ink is discharged from the container 216 into the reservoir 50. Thus, the bottle is not opened until it is mating with the hopper 50 and has been rotated.

The arrangement of the invention is also advantageous in ensuring that when the refill container is removed from the reservoir, the container is closed. This aspect is desirable in that even after toner is discharged from the refill container, residues remain in the container which can scatter if the container is open. In accordance with the invention, after the refill operation has been completed, the container is rotated in the opposite direction (counterclockwise with respect to FIG. 6) which results in closing of the container by once again aligning the projections 210 and 322 so that the apertures of the inner grating and outer grating are not aligned with one another. More particularly, upon counterclockwise rotation of the container 216, the stops 74 will act as stops for both the projections 210 and the projections 322 so that they will be aligned with respect to one another and with respect to the slots 72. At this point, the container is closed, and since the projections 210, 322 are aligned with respect to the slots 72, the toner bottle can be removed from the toner reservoir 50. If the projections 210, 322 are not aligned with respect to one another and with respect to the slots 302, the container cannot be removed from the hopper and thus, inadvertent spillage of toner from the container is prevented.

As shown in FIGS. 18 and 19, the projections 322 of the outer grating have a different size and shape as compared with the projections 210 of the base member. In particular, the projections 322 extend a greater distance radially and additionally include a depending arm or ledge 322*a*. Thus, the stops 76 can be sized and positioned so that they engage the projections 322 but they do not engage the projections 210.

As mentioned above, it is to be understood that various different relationships of the stops are also possible. By way of a further example, the stops 76 could be positioned adjacent to the slots 72 so that the outer grating 206 does not rotate substantially before opening of the bottle commences. In fact, the edge of the recesses or slots 72 itself can provide the stops for the projections 322 of the outer grating. In particular, by sizing the projections 322 and associated depending ledges 322*a* such that when the bottle (or more particularly the engagement device 200 of the bottle) is inserted into the aperture 58, the recess itself retains the projections 322 of the outer grating. Thus, with this arrangement, upon insertion of the bottle into the aperture 58, the outer grating is fixed in place, and rotation of the bottle rotates the inner grating with respect to the outer grating. Upon this rotation, the openings of the respective gratings overlap to thus provide communication between the bottle and the reservoir. In addition, since the projections 210 are inserted through the recesses or slots 72, the rotation also locks the bottle to the reservoir while the bottle is in an open or partially open position. Where the outer grating is locked immediately upon insertion into the opening 58, additional stops for the projections 210 are nevertheless desirable so that the rotation of the bottle is halted at a desired position at which the openings of the inner and outer gratings are fully aligned and the bottle is fully opened. The arrangement of the invention is particularly advantageous in that the stops 74 and 76 together ensure that when the container is inserted and rotated until halted, the container is fully opened to allow for the discharge of the toner, and when the container is rotated in the opposite direction the reverse rotation is halted when the projections 210, 322 are aligned so that the container is closed.

Thus, the engagement device 200 of the invention includes at least two gates or grating members, each having at least one orifice, which can be rotated relative to each other thereby allowing through-hole 500 to be selectively formed by the rotation thereof. In addition, projections 322 of outer grating 206 and projections 210 of base member 202 are arranged and configured such that, when aligned with each other, projections 210 and 322 can be inserted into the slots 72 of the reservoir aperture 58. Therefore, by simply rotating a toner container such as toner container 216, projections 210 rotate relative to projections 322, thereby engaging inner surface 64 and free edge 60.

A toner refill kit in accordance with the present invention can include a replacement toner reservoir 50 and/or a toner container which is utilized to refill the toner reservoir 50. For example, the kit can include a refillable reservoir which is used to replace an existing non-refillable reservoir, and optionally, the kit can also include a refill container for replenishing the refillable reservoir. After the initial replacement of the non-refillable reservoir with the refillable reservoir, the user need only purchase the relatively inexpensive refill container for subsequent replenishments.

As should be apparent from the foregoing, the present invention is advantageous in that hoppers which were previously replaced each time they were depleted now need only be replaced once with the toner reservoir in accordance with the present invention. Thereafter, subsequent replenishments can be effected utilizing the toner refill container or bottle of the present invention. Since the toner refill container does not act as a hopper for the image forming apparatus, it need not conform to the contours or idiosyncracies of a particular image forming apparatus. Thus, the toner refill container can have an extremely simple design. Further, a common toner refill container can be utilized for various types of image forming apparatus, thus reducing the need to inventory a large number of different types of toner reservoirs or toner refill containers. Thus, in accordance with the present invention, when a user is faced with the depletion of a non-reusable toner reservoir in an image forming apparatus, the user replaces the reservoir with a reservoir in accordance with the present invention—i.e., a reusable reservoir having a resealable opening. This reusable opening will typically be shipped with an initial supply of toner, but could also be supplied empty. Once the reusable toner reservoir of the present invention has been installed, subsequent replenishment operations are effected utilizing the toner refill container or bottle.

Obviously, numerous modifications and variations of the present invention are possible in light of the above teachings. It is therefore to be understood that within the scope of the appended claims, the invention may be practiced otherwise than as specifically described herein.

What is claimed is:

1. An ink reservoir comprising:

a body portion configured to store ink in an interior of said body portion;

an orifice through which ink is received to provide ink in said body portion; and means for holding an ink container in which the ink container includes inner and outer gratings which are rotatable relative to one another to selectively open and close said ink container, said means for holding including means for fixedly retaining one of said inner and outer gratings and rotatably holding the other of said inner and outer gratings so that said ink container can be selectively opened and closed while being held by said means for holding, and wherein said means for holding holds the ink container adjacent to said orifice so that ink can be transferred from said ink container to said ink reservoir.

2. The ink reservoir according to claim 1, wherein said ink reservoir further comprises at least one stop for halting rotation of said other of said inner and outer gratings when said ink container is open.

3. The ink refill kit according to claim 1, wherein said closure member further comprises sealing means disposed on a closure surface to form a seal with an outer surface of said ink reservoir disposed adjacent to said orifice.

4. The ink refill kit according to claim 3, wherein said closure member further comprises at least two projections spaced from said lower surface and wherein said orifice includes at least two recesses, and further wherein said at least two projections are configured to pass through said at least two recesses.

5. The ink reservoir according to claim 1, further comprising an ink discharge port configured to communicate with an ink input port of an image forming apparatus.

6. The ink reservoir according to claim 5, wherein said body portion is configured to be received within an interior of the image forming apparatus.

7. An ink reservoir as recited in claim 1, wherein said means for holding includes means for preventing removal of said ink container unless said ink container is closed.

8. An ink reservoir as recited in claim 7, further including a first stop for halting rotation of said other of said inner and outer gratings when said other of said inner and outer gratings is moved to an open position, the ink reservoir further including a second stop for halting rotation of said other of said inner and outer gratings when said other of said inner and outer gratings is moved to a closed position.

9. An ink refill kit comprising:

(a) an ink reservoir having:

(i) a body portion configured to store ink in an interior of said body portion, said ink reservoir including an ink discharge port configured to communicate with an ink input port of an image forming apparatus; and (ii) an orifice provided on said body portion, said orifice defining a circular free edge, said free edge including at least one recess;

(b) an ink container comprising:

(i) an outlet orifice and a base member provided on the outlet orifice of the ink container;

(ii) an outer grating member rotatably mounted upon said base member, said outer grating including at least one outer grating orifice; and (iii) an inner grating member having at least one inner grating orifice, wherein said inner grating member is fixed with respect to said base member such that said at least one outer grating orifice selectively communicates with said at least one inner grating orifice through rotation of said outer grating member relative to said base member;

said base member having an engagement surface configured to mate with an outer surface of said free edge, wherein at least one projection extends from said outer grating member and, wherein said projection is configured to be received by said at least one recess formed on said free edge such that when said base member mates with said outer surface of said free edge said at least one projection is received by said at least one recess and said outer grating is held in place, and further wherein said base member and said inner grating member are fixedly mounted with respect to said ink container such that rotation of said ink container causes rotation of said inner grating member with respect to said outer grating member between closed and open positions, wherein in said closed position said at least one inner grating orifice does not overlap with said at least one outer grating orifice and in said open position said at least one inner grating orifice overlaps with said at least one outer grating orifice to allow ink to pass from said ink container through said inner and outer grating orifices and into said ink reservoir to replenish said ink reservoir.

10. The ink refill kit according to claim 9, further comprising a closure member which closes said orifice of said ink reservoir to prevent ink from passing through said orifice.

11. The ink refill kit according to claim 10, wherein said closure member is tethered to said body portion of said ink reservoir.

12. The ink refill kit according to claim 10, wherein said body includes an annular wall surrounding said orifice, and wherein said closure member includes an annular surface having an outer diameter sized to form a slip fit with said annular wall.

13. The ink refill kit according to claim 10, wherein said closure member further comprises sealing means provided on a closure surface thereof, wherein said sealing member is configured to mate with said outer surface of said free edge.

14. The ink refill kit according to claim 10, wherein said outer grating comprises at least two outer grating orifices and said inner grating comprises at least two inner grating orifices alignable with said at least two outer grating orifices.

15. The ink refill kit according to claim 9, wherein said outer grating member includes at least two projections arranged to be aligned with at least two projections formed on said base member, wherein at least one of said at least two projections of said outer grating member includes a ledge disposed radially outward from said at least two projections formed on said base member, wherein said ledge extends toward said engagement surface of said base member to a position closer to said engagement surface than an outward edge of said at least two projections of said base member, and further wherein said at least two projections of said base member and said at least two projections of said outer grating are disposed such that when the projections of the base member are aligned with the projections of the outer grating the inner grating orifice does not overlap with the outer grating orifice.

16. The ink refill kit according to claim 15, wherein said free edge includes at least two recesses, and said at least two projections of said base member and said at least two projections of said outer grating are configured such that when aligned, together they can pass through said at least two recesses formed in said free edge, and wherein said at least one ledge is configured such that when said engagement surface of said base member is mated with said outer surface of said free edge, said ledge extends partially from one of said at least two recesses to lock said outer grating in place against rotation.

17. The ink refill kit according to claim 9, wherein said inner grating is fixedly attached to said base member.

18. An ink refill bottle comprising:

a body configured to store ink, said body including a mouth through which ink can be released from said body; and a closure assembly for selectively opening and closing said mouth to selectively release ink from said ink container said closure assembly including an inner grating extending across said mouth and having at least one opening, said closure assembly further including an outer grating extending across said mouth and having at least one opening, wherein said inner grating and said outer grating are rotatable relative to one another between open and closed positions, and wherein in said open position said at least one opening of said inner grating overlaps with said at least one opening of said outer grating so that ink can be released from said body through said mouth and said openings, and further wherein in said closed position said at least one opening of said inner grating does not overlap with said at least one opening of said outer grating such that said mouth is closed.

19. The ink refill bottle according to claim 18, wherein said outer grating is rotatably mounted with respect to said body and said inner grating is fixed with respect to said body, such that said closure assembly selectively opens and closes said mouth by rotating said body relative to said outer grating.

20. The ink refill bottle according to claim 18, further comprising means for releasably engaging the closure assembly with an orifice of an ink reservoir of an image forming apparatus.

21. The ink refilling container according to claim 20, wherein said means for releasably engaging the closure assembly comprises means for preventing rotation of said outer grating while allowing rotation of said inner grating.

22. A method for replenishing an ink supply in an image forming apparatus in which the image forming apparatus includes a non-refillable ink reservoir comprising:

removing said non-refillable ink reservoir;

replacing said non-refillable ink reservoir with a refillable ink reservoir, said refillable ink reservoir including a refill aperture and a removable closure member which closes said refill aperture;

providing an ink refill container having a dispensing portion which mates with said refill aperture of said refillable ink reservoir, said ink refill container having a supply of ink therein;

removing said closure member from said refill aperture;

inserting said dispensing portion into said refill aperture; and transferring ink from said toner refill container into said refillable ink reservoir;

wherein said dispensing portion includes an inner grating and an outer grating, and wherein said inner and outer gratings are rotatable relative to one another and each includes at least one aperture, and wherein said step of inserting said dispensing portion includes inserting said dispensing portion with the at least one aperture of the inner grating not overlapping the at least one aperture of the outer grating, and further wherein said step of transferring ink includes rotating said inner grating with respect to said outer grating so that said at least one aperture of said outer grating overlaps with said at least one aperture of said inner grating and an interior of said refill container is in communication with an interior of said refillable ink reservoir and ink is transferred from said ink refill container into said refillable ink reservoir.

23. The method as recited in claim 22, further including, after the step of inserting said dispensing portion, locking said ink refill container to said refillable ink reservoir with a locking assembly which lock the ink refill container to the refillable ink reservoir unless said ink refill container is closed, wherein the step of rotating said inner grating includes rotating said inner grating in a first direction until rotation is halted by a first stop, wherein said first stop is positioned such that rotation is halted when said apertures of said inner and outer gratings overlap and said ink refill container is open, said method further including, after the ink is transferred from said ink refill container to said refillable ink reservoir, rotating said inner grating in a second direction opposite to said first direction until rotation is halted by a second stop, and wherein said second stop is positioned such that rotation in said second direction is halted when said apertures do not overlap and said ink refill container is closed.

24. An ink refill kit comprising:

(a) an ink reservoir comprising:

(i) a body portion configured to store ink, and an ink discharge port configured to communicate with an ink input port of an image forming apparatus; and (ii) an orifice provided on said body portion for receiving ink to replenish said ink reservoir;

(b) an ink container for replenishing said ink reservoir, said ink container comprising:

(i) a body portion for storing toner, said body portion including a mouth to allow toner to be released from the body portion of the toner container and into the orifice of the ink reservoir to replenish the ink reservoir;

(ii) a closure assembly for selectively opening and closing said mouth to selectively release ink from said ink container, said closure assembly including an inner grating extending across said mouth and having at least one opening, said closure assembly further including an outer grating extending across said mouth and having at least one opening, wherein said inner grating and said outer grating are rotatable relative to one another between open and closed positions, and wherein in said open position said at least one opening of said inner grating overlaps with said at least one opening of said outer grating so that ink can be released from said body through said mouth and said openings, and further wherein in said closed position said at least one opening of said inner grating does not overlap with said at least one opening of said outer grating such that said mouth is closed.

25. The ink refill kit according to claim 24, further including a closure member for closing said orifice of said ink reservoir, wherein said closure member is tethered to said body portion of said ink reservoir.

26. The ink refill kit according to claim 25, wherein said closure member comprises at least one projection and said ink reservoir includes at least one recess disposed adjacent to said orifice, and wherein said at least one projection is configured to pass through said at least one recess.

27. The ink refill kit according to claim 25, wherein said body portion of said ink reservoir further comprises an annular wall surrounding said orifice, and wherein said closure member includes an annular surface having an outer diameter sized to provide a slip fit with said annular wall.

28. An ink refill kit as recited in claim 24, wherein said inner grating is fixed with respect to said body portion of said ink reservoir and said outer grating is rotatable relative to said body portion of said ink container, and wherein said ink reservoir includes means for holding said ink container adjacent to said orifice, wherein said means for holding holds said outer grating in place and rotatably holds said inner grating such that, when said ink container is held by said means for holding, rotation of said body portion moves said closure assembly between said open and said closed positions.

29. An ink refill kit as recited in claim 28, wherein said ink reservoir includes a first stop member disposed adjacent to said orifice, and said ink container includes a first projection, and wherein said first stop halts rotation of said body of said ink container when said first projection contacts said first stop, and wherein said closure assembly is in said open position when said first projection contacts said first stop, whereby when said ink container is mounted upon said ink reservoir, said ink container is rotated until said first projection contacts said first stop so that said closure assembly is open and ink passes from said body of said ink container into said body of said ink reservoir.

30. An ink refill kit as recited in claim 29, wherein said ink reservoir further includes a second stop, and wherein said second stop halts reverse rotation of said body such that after said body has been rotated so that said closure assembly is in said open position, said body is rotated in a reverse direction until said first projection contacts said second stop, and wherein said closure assembly is in said closed position when said first projection contacts said second stop.

31. An ink refill kit as recited in claim 24, further including means for holding said ink container adjacent to said orifice, said means for holding including means for preventing removal of said ink container from said ink reservoir unless said closure assembly is in said closed position.

* * * * *

UNITED STATES PATENT AND TRADEMARK OFFICE

CERTIFICATE OF CORRECTION

PATENT NO. : 6,209,995 B1
DATED : April 3, 2001
INVENTOR(S) : Guerry L. Grune et al.

It is certified that error appears in the above-identified patent and that said Letters Patent is hereby corrected as shown below:

Column 14,
Line 44, change “1” to -- 25 --.

Column 16,
Line 58, change “refilling container” to -- refill bottle --.

Signed and Sealed this

Tenth Day of February, 2004

JON W. DUDAS
*Acting Director of the United States Patent and Trademark Office*